United States Patent [19]

Koeneman et al.

[11] Patent Number: 4,909,047

[45] Date of Patent: Mar. 20, 1990

[54] BEVERAGE DISPENSING SYSTEM

[75] Inventors: Robert M. Koeneman, Oak Brook; Benjamin D. Miller, Chicago; Thaddeus M. Jablonski, Palatine, all of Ill.

[73] Assignee: Remcor Products Company, Franklin Park, Ill.

[21] Appl. No.: 156,346

[22] Filed: Feb. 16, 1988

[51] Int. Cl.[4] ..... B67D 5/62

[52] U.S. Cl. ..... 62/389; 62/398; 222/146.6; 222/318

[58] Field of Search ..... 62/389, 390, 398, 400; 222/640, 641, 146.6, 318

[56] References Cited

U.S. PATENT DOCUMENTS

| | | | |
|---|---|---|---|
| 1,654,379 | 12/1927 | Matzka | 222/318 X |
| 3,119,531 | 1/1964 | Jacobs | 222/318 |
| 3,309,886 | 3/1967 | Welty | 62/389 X |
| 3,331,536 | 7/1967 | Lorenzo | 62/398 X |
| 4,502,294 | 3/1985 | Grant | 62/389 |
| 4,679,408 | 7/1987 | Nelson | 222/146.6 X |

FOREIGN PATENT DOCUMENTS

| | | | |
|---|---|---|---|
| 2318367 | 2/1977 | France | 222/318 |

*Primary Examiner*—Lloyd L. King

*Attorney, Agent, or Firm*—Juettner Pyle Lloyd & Verbeck

[57] ABSTRACT

A beverage dispensing system has a plurality of dispensing faucets, each of which is supplied with carbonated water (soda) and a selected flavor of syrup. The syrups and soda are chilled upstream of the faucets, and after chilling the soda is introduced into a manifold from which it is distributed to each faucet. In order that a warm beverage will not be dispensed from a faucet as a result of the soda becoming warm downstream from the point of chilling upon the system standing idle for a period of time, soda is withdrawn from the manifold either continuously or periodically to maintain the soda downstream from the chilling point in a cold state.

25 Claims, 2 Drawing Sheets

BEVERAGE DISPENSING SYSTEM

BACKGROUND OF THE INVENTION

The present invention relates to beverage dispensing systems in general, and in particular to an improved post-mix beverage dispensing system that always dispenses chilled beverages irrespective of the time lapse between dispensing of beverages.

In a typical post-mix beverage dispensing system, carbonated water (soda) and various flavored syrups flow through individual circuits of stainless steel tubing embedded in a cost aluminum cold plate. Cooling of the syrups and soda in the cold plate is accomplished by maintaining ice on the surface of the plate. One means of delivering ice to and maintaining ice on the surface of a cold plate is described in U.S. Pat. No. 4,300,359, in which ice from a hopper of an ice dispenser is conveyed by gravity to an enclosure in which a cold plate is positioned, so that a supply or ice is always maintained around the cold plate.

Chilled syrups leaving the cold plate are conveyed through insulated tubes directly to individual ones of a plurality of dispensing faucets. On the other hand, chilled soda leaving the cold plate is introduced into a manifold, typically of insulated stainless steel, that distributes soda to each faucet through individual outlet taps. When a faucet is actuated to dispense a beverage, soda water and a selected flavored syrup flow to the faucet and mix as they are dispensed, usually in a ratio of 5 parts soda to 1 part syrup.

As long as beverages are relatively frequently dispensed, they flow from the faucets in a chilled state. However, when the system stands idle for a period of time, although the syrup and soda within the cold plate itself are maintained cold, the first beverage dispensed after an idle period comes from the delivery lines and soda manifold. This product warms up as it stands, due to absorption of heat from the surrounding ambient, and can no longer be cooled. The first drink drawn after an idle period will therefore be warmer than the usually desired 40° F., resulting in excessive foaming and a generally undesirable drink.

OBJECT OF THE INVENTION

The primary object of the present invention is to provide an improved beverage dispensing system in which chilled beverages are always drawn from the system even after the system has been idle for a period of time.

SUMMARY OF THE INVENTION

In accordance with the present invention, a beverage dispensing system comprises dispensing faucet means, beverage chilling means, and conduit means for delivering beverage from the beverage chilling means to the dispensing faucet means. Also included are means for at least periodically withdrawing beverage from the conduit means, at a point intermediate the faucet means and chilling means, to maintain beverage in the conduit means in a chilled state for delivery to the dispensing faucet means.

To prevent excessive warming of beverage in the conduit means, the at least periodically withdrawing means withdraws beverage at a rate such that beverage in the conduit means is changed in about fifteen minutes or less. The at least periodically withdrawing means may comprise valve means in an outlet from the conduit means, and timer means coupled with the valve means for periodically opening the valve means. On the other hand, the periodically withdrawing means may comprise means for continuously withdrawing beverage from the conduit means, such as a restricted orifice in an outlet from the conduit means.

The invention also contemplates a method of dispensing a chilled beverage, which comprises the steps of chilling the beverage, delivering the chilled beverage through a conduit to a beverage dispensing faucet, and periodically operating the faucet to dispense the beverage. Also included is the step of at least periodically withdrawing beverage from the conduit slightly upstream of the faucet to maintain the beverage in the conduit in a chilled state for delivery to the faucet. The at least periodically withdrawing step may comprise continuously withdrawing beverage from the conduit, and advantageously beverage is withdrawn at a rate sufficient to change the volume of beverage in the conduit in about fifteen minutes or less.

The foregoing and other objects, advantages and features of the invention will become apparent upon a consideration of the following detailed description, when taken in conjunction with the accompanying drawings.

DETAILED DESCRIPTION

Figure 1:
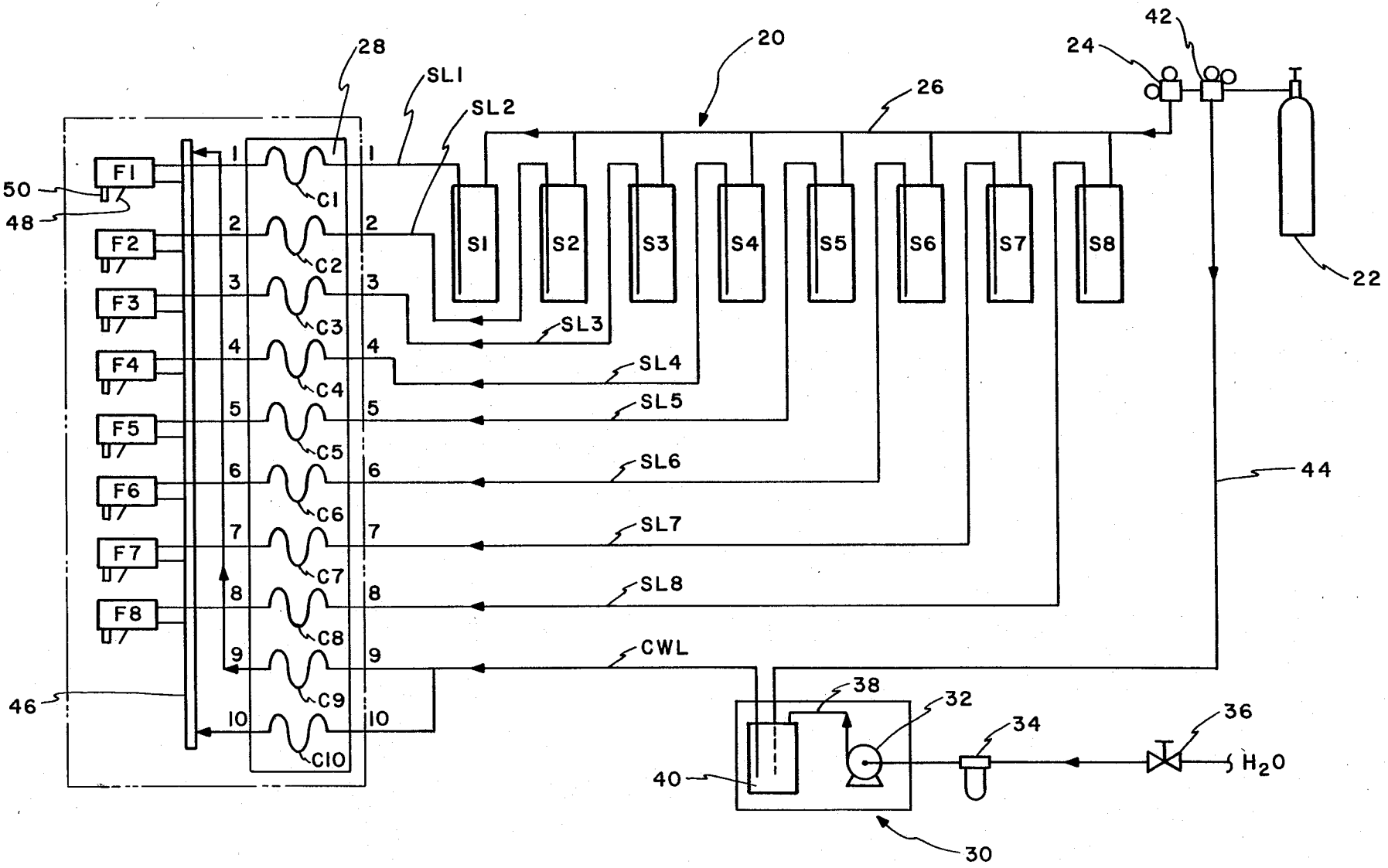
FIG. 1 is a schematic representation of a beverage dispensing system of a type with which the teachings of the present invention may advantageously be used.

FIG. 1 illustrates a beverage dispensing system, indicated generally at 20, that includes a plurality of supply tanks S1–S8 of selected flavors of syrup. Each tank is pressurized to about 15–50 psi with carbon dioxide from a $CO_2$ supply 22 through a regulator 24 and a line 26. Syrup outlet lines SL1–SL8 from the tanks deliver the various flavors of syrup under pressure to respective inlets 1–8 to a cold plate 28.

The system also has a carbonator, indicated generally at 30, that includes a high pressure pump 32 having an inlet connected through a filter 34 and a valve 36 to a supply of water. An outlet from the pump connects through a line 38 to a first inlet to a water carbonating tank 40, a second inlet to which connects with the $CO_2$ supply 22 through a regulator 42 and a line 44 for receiving $CO_2$ at a pressure of about 60–100 psi. The carbonator works in a manner known in the art to charge the water with $CO_2$ within the tank 40, and an outlet from the tank connects through a carbonated water line CWL to inlets 9 and 10 to the cold plate 28.

As is known, the cold plate 28 includes a plurality of individual cooling circuits of stainless steel tubing embedded in a cast aluminum cold plate, such as the circuits C1–C10 connected to the inlets 1–10, so that syrups from the tanks S1–S8 flow through respective ones of the circuits C1–C8 and soda from the carbonator 30 flows through the circuits C9 and C10. The cold plate cools the syrups and soda flowing through its circuits, and cooling is accomplished by maintaining ice in contact with the cold plate. One means for delivering ice to and maintaining ice in contact with the cold plate is described in U.S. Pat. No. 4,300,359, assigned to the assignee of the present invention. According to that patent, ice from a hopper of an ice dispenser is conveyed by gravity through a conduit to a cold plate in a chamber beneath the hopper, so that a supply of ice is always maintained around the cold plate.

The circuits C1–C10 of the cold plate 28 extend between the inlets 1–10 and respective outlets 1–10 from the plate, so that warm syrups at the inlets 1–8 and warm soda at the inlets 9 and 10 are cooled in passing through the circuits and are delivered from the respective outlets 1–10 in a chilled state. The chilled syrups at the outlets 1–8 are directly connected to syrup inlets to respective ones of a plurality of dispensing faucets F1–F8. Chilled soda at the cold plate outlets 9 and 10, however, is introduced into carbonated water inlets CW at opposite ends of a soda manifold 46, and a plurality of outlet taps from the manifold connect to soda inlets to the faucets F1–F8, so that each faucet receives both soda and syrup. The soda manifold is usually of insulated stainless steel, and its use minimizes the number of tubing circuits that otherwise would be required in the cold plate to provide chilled soda to each faucet.

The faucets are of a conventional type, and each includes an actuating lever and an outlet, such as an actuating lever 48 and an outlet 50 of the faucet F1. When a beverage is caused to flow from a faucet, by placing a cup beneath the faucet outlet and engaging the actuating lever with the cup, soda and a flavored syrup flow from the faucet and are mixed are they are dispensed into the cup, typically in a ratio of 5 parts soda to 1 part syrup.

To the extent described, the beverage dispensing system is conventional, and will dispense chilled beverages as long as they are drawn relatively frequently. When such a system stands idle, the syrups and soda within the cold plate 28 are maintained cold as long as ice is available on and around the plate. The first beverage drawn after an idle period, however, comes from the delivery lines and the soda manifold between the cold plate and faucets, and during the idle period this product warms up as it stands, due to absorption of heat from the surrounding ambient, and can no longer be cooled. Consequently, the first beverage drawn after an idle period ("casual draw") will be warmer than a usually desired 40° F., resulting in excessive foaming and a generally undesirable drink.

In improving upon conventional beverage dispensing systems, the invention prevents a warm beverage from being dispensed upon a casual draw after a period of idle standing. This may be accomplished by allowing a small amount of soda to continuously bleed out of the soda manifold 46, or by periodically relatively rapidly withdrawing soda from the manifold as close as possible to the faucets F1–F8. The soda bled off or withdrawn flows down a drain and is replaced by cold soda from the cold plate. The technique maintains the soda in the system downstream of the cold plate at about cold plate temperature, and since soda comprises 5 out of 6 parts of a beverage, a cold casual draw is ensured.

Figure 2:
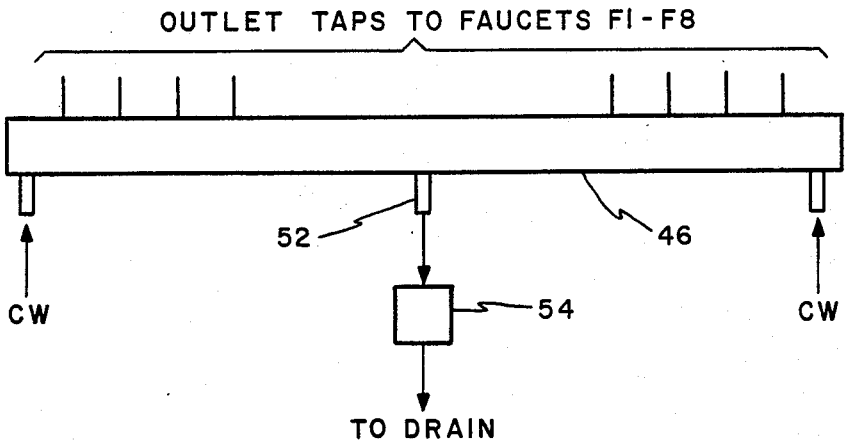
FIG. 2 is a schematic representation of a carbonated water (soda) manifold of the dispensing system, that according to the invention has a flow-controlled outlet tap for maintaining a supply of chilled soda in the manifold, and FIGS. *3a–3d* illustrate various embodiments of flow-control devices for the outlet tap from the manifold.
Figure 3A:
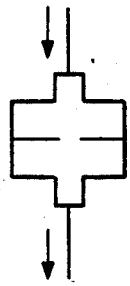
Figure 3B:
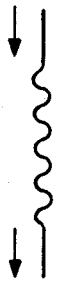
Figure 3C:
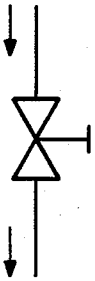
Figure 3D:
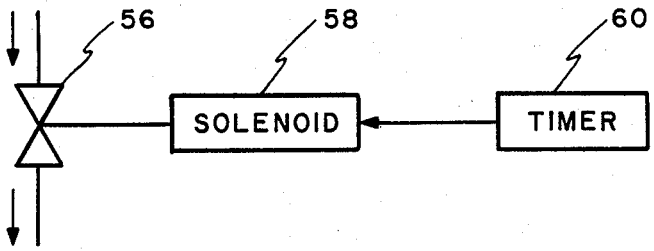

FIG. 2 illustrates a modification of the soda manifold 46 according to the invention. The maintain a cold supply of soda in the manifold, a bleed outlet tap 52 at the center of the manifold connects through a flow metering device 54 to a drain. The metering device is operative to control a flow of soda out of the manifold, and therefore a flow of cold soda from the cold plate 28 to the manifold, in a manner to maintain soda in the manifold in a chilled state.

FIGS. *3a–3d* illustrate various contemplated embodiments of the metering device 54. As seen in FIG. *3a*, the metering device may comprise a restricted orifice, according to FIG. *3b* it may be a restricted capillary tube, or as shown in FIG. *3c* it may be an adjustable needle valve. Each of these metering devices would provide a continuous bleed off of soda from the manifold at a controlled flow rate selected to maintain soda in the manifold cold without excessive loss of soda. It has been found that with a reasonably well insulated manifold, a suitable flow rate is one that changes the volume of soda downstream of the cold plate approximately once every 10–15 minutes or less. An advantage to using either the fixed orifice, fixed capillary or needle valve as a metering device is that each is simple in structure and easy to implement into the beverage dispensing system.

Instead of providing a continuous bleed off of soda from the manifold 46, it is also contemplated that the metering device 54 may be of a type that periodically withdraws soda from the manifold. Thus, as seen in FIG. *3d* the metering device may comprise a valve 56 operated by a solenoid 58 under control of a timer 60. The timer is adjusted to operate the solenoid and open the valve to provide a fast bleed periodically, but usually no less frequently than once about every 10–15 minutes, so that the average volume flow of soda through the valve is about the same as would occur through the continuous bleed devices of FIGS. *3a–3c*. If desired, to prevent unnecessary loss of soda, the timer may be reset whenever a beverage is dispensed.

While embodiments of the invention have been described in detail, various modifications and other embodiments thereof may be devised by one skilled in the air without departing from the spirit and scope of the invention, as defined in the appended claims.

What is claimed is:

1. A beverage dispensing system, comprising beverage dispensing faucet means; beverage chilling means; conduit means for delivering beverage from a supply thereof and through said chilling means to said faucet means; and means for at least periodically controllably withdrawing beverage from said conduit means at a point intermediate said faucet means and said chilling means, and for discharging the beverage from said system, to maintain beverage in said conduit means, intermediate said chilling means and faucet means, in a chilled state for delivery to said faucet means.

2. A beverage dispensing system as in claim 1, wherein said point intermediate said faucet means and chilling means is closer to said faucet means.

3. A beverage dispensing system as in claim 1, wherein said means for at least periodically withdrawing and discharging comprises means for continuously withdrawing and discharging beverage from said conduit means.

4. A beverage dispensing system as in claim 3, wherein said continuously withdrawing and discharging means withdraws beverage at a rate sufficient to change the volume of beverage in said conduit means, intermediate said chilling means and faucet means, in about 15 minutes or less.

5. A beverage dispensing system as in claim 3, wherein said conduit means has an outlet at said point, and said means for continuously withdrawing and discharging includes a restricted orifice in line with said outlet.

6. A beverage dispensing system, comprising beverage dispensing faucet means; beverage chilling means; conduit means for delivering beverage from said chilling means to said faucet means; and means for at least periodically controllably withdrawing beverage from said conduit means, at a point intermediate said faucet means and said chilling means, to maintain beverage in said conduit means in a chilled state for delivery to said faucet means, said conduit means having an outlet at said point, and said means for continuously withdrawing includes a capillary tube in line with said outlet.

7. A beverage dispensing system as in claim 3, wherein said conduit means has an outlet at said point, and said means for continuously withdrawing and discharging includes adjustable valve means in line with said outlet for controlling the rate of withdrawal and discharge of beverage.

8. A beverage dispensing system, comprising beverage dispensing faucet means; beverage chilling means; conduit means for delivering beverage from said chilling means to said faucet means; and means for at least periodically controllably withdrawing beverage from said conduit means, at a point intermediate said faucet means and said chilling means, to maintain beverage in said conduit means in a chilled state for delivery to said faucet means, said conduit means having an outlet at said point, and said means for at least periodically withdrawing includes valve means in line with said outlet, and timer means coupled with said valve means for periodically opening said valve means.

9. A beverage dispensing system, comprising a plurality of beverage dispensing faucet means, each having a flavored syrup inlet and a carbonated water (soda) inlet; beverage chilling means including a cold plate surrounded by ice, said cold plate having a plurality of syrup inlets, each for connection with an associated supply of syrup, at least one soda inlet for connection with a supply of soda, and tubing circuits extending between said syrup inlets and associated syrup outlets and between said at least one soda inlet and at least one soda outlet, whereby syrups and soda are chilled in flowing from said inlets to said outlets of said cold plate; tubing means connecting each said cold plate syrup outlet to said syrup inlet to a respective one of said dispensing faucet means; conduit means connecting said at least one cold plate soda outlet to said soda inlets to each said dispensing faucet means; and means for at least periodically controllably withdrawing soda from said conduit means, at a point intermediate said cold plate and said plurality of dispensing faucet means, to maintain soda in said conduit means in a chilled state for delivery to said plurality of dispensing faucet means.

10. A beverage dispensing system as in claim 9, wherein said conduit means includes a soda manifold having a plurality of outlet taps connected to said soda inlets to said plurality of dispensing faucet means, and said means for at least periodically withdrawing said withdraws soda from said manifold.

11. A beverage dispensing system as in claim 10, wherein said manifold is elongate and said outlet taps extend along the length of said manifold, and opposite ends of said manifold are connected to said at least one cold plate soda outlet, and said means for at least periodically withdrawing soda withdraws soda from said manifold at a point about midway between opposite ends of said manifold.

12. A beverage dispensing system as in claim 9, wherein said means for at least periodically withdrawing soda withdraws soda at a rate sufficient to change the volume of soda in said conduit means in about 15 minutes or less.

13. A beverage dispensing system as in claim 9, wherein said means for at least periodically withdrawing comprises means for continuously withdrawing soda from said conduit means.

14. A beverage dispensing system as in claim 13, wherein said means for continuously withdrawing includes a restricted orifice through which soda is withdrawn from said conduit means.

15. A beverage dispensing system as in claim 13, wherein said means for continuously withdrawing includes a capillary tube through which soda is withdrawn from said conduit means.

16. A beverage dispensing system as in claim 13, wherein said continuously withdrawing means includes adjustable valve means through which soda is withdrawn from said conduit means.

17. A beverage dispensing system as in claim 9, wherein said means for at least periodically withdrawing includes valve means through which soda is withdrawn from said conduit means, and timer means coupled with said valve means for periodically opening said valve means.

18. A method of dispensing a chilled beverage, comprising the steps of chilling beverage from a supply thereof; delivering the chilled beverage through a conduit to a beverage dispensing faucet; periodically operating the faucet to dispense the beverage; and at least periodically withdrawing beverage from the conduit upstream of the dispensing faucet and discharging the beverage to a drain to maintain the beverage in the conduit in a chilled state for delivery to the dispensing faucet.

19. A method as in claim 18, wherein said at least periodically withdrawing and discharging step comprises continuously withdrawing and discharging beverage from the conduit upstream of the dispensing faucet.

20. A method as in claim 18 wherein said at least periodically withdrawing and discharging step withdraws and discharges beverage at a rate sufficient to change the volume of beverage in the conduit in about 15 minutes or less.

21. A method of dispensing chilled beverages from a plurality of dispensing faucets, each faucet having a syrup inlet and a carbonated water (soda) inlet, comprising the steps of connecting each of a plurality of supplies of flavored syrups through tubing with the syrup inlet to a respective one of the dispensing faucets; chilling the syrups upstream of the dispensing faucets; connecting a supply of soda through a conduit to the soda inlets to the dispensing faucets; chilling the soda upstream of the dispensing faucets; at least periodically operating at least one of the dispensing faucets to dispense a beverage of a flavored syrup and soda; and at least periodically withdrawing soda from the conduit intermediate the dispensing faucets and the point where the soda is chilled to maintain the soda in the conduit upstream of the dispensing faucets in a chilled state for delivery to the dispensing faucets.

22. A method as in claim 21, wherein the conduit, intermediate the point where the soda is chilled and the dispensing faucets, includes a manifold having a plurality of outlet taps connected to the soda inlets to the dispensing faucets, and said withdrawing step comprises at least periodically withdrawing soda from the manifold.

23. A method as in claim 21, wherein said withdrawing step further comprises withdrawing soda from the conduit at a rate sufficient to change the volume of soda in the conduit in about 15 minutes or less.

24. A method as in claim 22, wherein said at least periodically withdrawing step comprises withdrawing soda from the manifold.

25. A method as in claim 21. wherein said withdrawing step comprises continuously withdrawing soda from the conduit through a restricted orifice.

* * * * *